United States Patent [19]

Swarbrick

[11] 4,306,226

[45] Dec. 15, 1981

[54] ANIMATION OF VISUAL DISPLAYS AND APPARATUS EFFECTING THE ANIMATION

[76] Inventor: John Swarbrick, 480 S. Maple St., Nokomis, Ill. 62075

[21] Appl. No.: 78,382

[22] Filed: Sep. 24, 1979

[51] Int. Cl.[3] ..... G08B 5/36

[52] U.S. Cl. ..... 340/378.4; 540/378.6; 40/453

[58] Field of Search ..... 340/378.4, 806, 373, 340/378.5; 40/453

[56] References Cited

U.S. PATENT DOCUMENTS 3,082,560 3/1963 Elvestrom ..... 40/453 X
3,636,552 1/1972 Orima ..... 340/378.4 X
3,683,525 8/1972 Fukui ..... 40/453 X
3,839,714 10/1974 Janning ..... 340/774
3,914,761 10/1975 Murase et al. ..... 340/378.4 X
3,918,185 11/1975 Hasala ..... 40/453 X

*Primary Examiner*—David L. Trafton
*Attorney, Agent, or Firm*—Gravely, Lieder & Woodruff

[57] ABSTRACT

A visual display in which written, pictorial or combination thereof may be presented for viewing in an appealing manner for any of a variety of purposes, and apparatus for developing changes and/or animation in the display utilizing specially prepared transparent media by which the subject matter is presented and means to control the visual presentation of that subject matter and obtain change and/or animation effects.

3 Claims, 13 Drawing Figures

FIG. 7
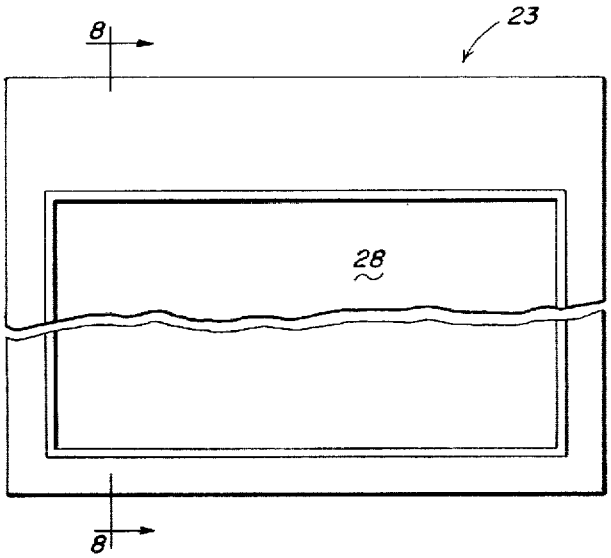
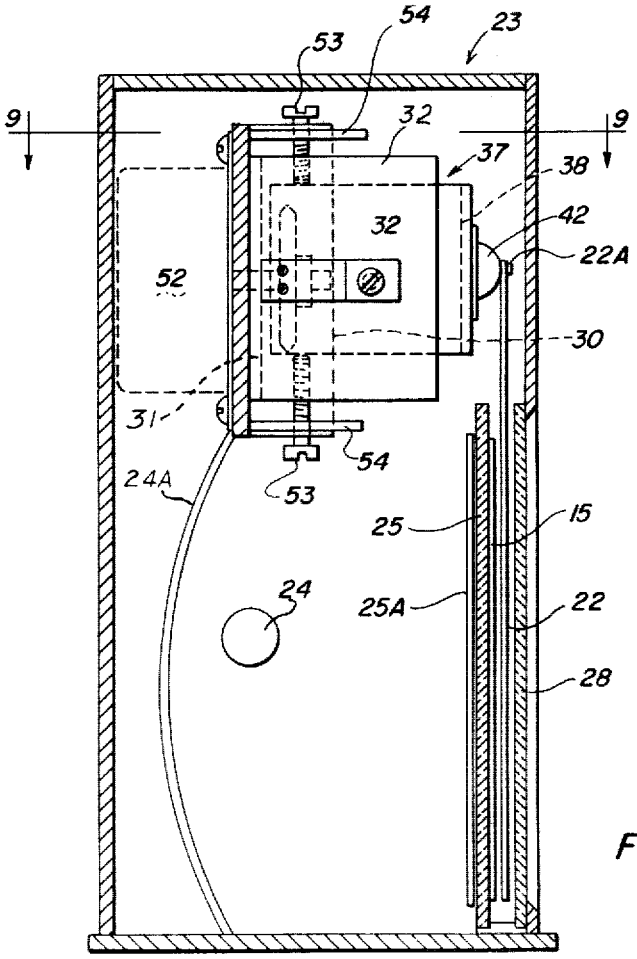
FIG. 8

ANIMATION OF VISUAL DISPLAYS AND APPARATUS EFFECTING THE ANIMATION

BACKGROUND OF THE INVENTION

It has been known in the past that commercial and other types of visual displays can attract the desired attention and great interest from all types of individuals if there is imparted to the display a pleasing animation effect.

In one form of prior animation display which was suggested by Fagan in U.S. Pat. No. 2,058,581 of Oct. 27, 1936 to use a slide having two different attitudes or appearances drawn or otherwise made by alternate full and dotted lines so that alternately the lines of one attitude could be registered with opaque lines and the other attitude could be made to register with a transparency in a moving endless band, or slide or disk, adapted to pass in front of or behind the slide in a suitable slide carrier. In such an arrangement the endless bank had to be provided with opaque sections at each side of the alternate opaque and transparent lines so that while traveling it would in effect bring in and block out the moving figure caused by the opaque and transparent lines of the screen. Furthermore, it was suggested that the slide could be moved in a reciprocating motion across the screen, as well as in a vertical or oblique movement to obtain motion in the display.

The foregoing prior art principle has been developed further by Rose et al in U.S. Pat. No 3,613,277 of Oct. 19, 1971 wherein a display or exhibit was constituted by a group of parallel interleaved strips arranged in overlapping relation in the means of a louver-like construction, and providing a plurality of such groups which could be moved through each other between withdrawn and extended positions so that one such group at a time could be visually inspected.

In a somewhat different arrangement it has been disclosed in U.S. Pat. No. 1,172,360 of Hildburgh, Feb. 22, 1916 to provide in advertising machinery two or more plates adjacent for the purpose of selectively uncovering and covering portions of transparent areas so as to develop a number of different designs to be observed by relatively moving the plates. In this arrangement the distance between the openings relative to the size of the openings would enable an increase in the number of independent designs which could be produced.

BRIEF DESCRIPTION OF THE INVENTION

The present invention is directed to improvements in effecting animation of visual displays and to the improvements in apparatus for obtaining the animation thereof.

It is a principle object of the present invention to produce changes and/or animation in a visual display by the simple means of effecting relative movement between a predetermined form of layout of the display on a light transparent sheet and coupling the transparent sheet with an opaque sheet having a substantially matching arrangement of apertures such that selected portions of the display on the transparent sheet can be moved into view in a sequence that would result in the desired change and/or animation.

It is another object of the present invention to provide a method of presenting a visual display in which a light transparent sheet has reproduced thereon a plurality of separate renderings of a desired display arranged in scattered spacing over the transparent sheet, providing an opaque sheet with a plurality of apertures arranged in spaced relation for registering with different ones of the scattered separate renderings of the display such that light emitted through the registered apertures visually develops a separate rendering of the display, and moving the transparent sheet and the opaque sheet relative to each other in a predetermined sequence for effecting the simultaneous presentation to view each of the scattered portions of the separate renderings of the display.

It is a further object of the present invention to provide apparatus for obtaining the relative movement between a light transparent sheet carrying a plurality of separate renderings of a desired display and an opaque sheet for sorting out the separate renderings one at a time so that changes and/or animation can be imparted to the visual display.

Other objects and advantages of the present invention will be pointed out in the detailed description which follows.

BRIEF DESCRIPTION OF THE DRAWINGS

A preferred embodiment of the invention is illustrated in the accompanying drawings, wherein:

FIG. 7 is a front elevational view of a cabinet in which the operating mechanism is mounted to develop the relative motion depicted in FIGS. 3, 4, 5 and 6 between the transparency and mask to present the subject matter to view at a window;

FIG. 8 is an enlarged sectional view taken along line 8—8 in FIG. 7;

DETAILED DESCRIPTION OF THE INVENTION

Figure 1:
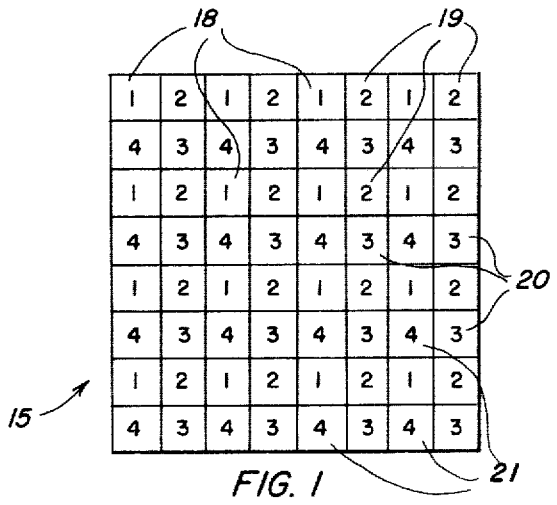
FIG. 1 is a plan view of the transparency sheet after it has been developed with finite areas of interspersed portions of four displayable subject matter designated for convenience by numerals 1, 2, 3 and 4.

It has been generally pointed out above that this invention is related to a method and apparatus for effecting animation in a visual display, as well as effecting a progressive change in the visual display so that different forms of information or pictoral presentations can be developed in a single display frame.

In carrying out the invention, the following description will relate to developing display of a common subject so that animation or motion can be secured. The common subject may be the face of a person in a plurality of different facial appearances, which appearances when shown in a sequence will reproduce and present desired animation or expressions in the face of such a person. In order to obtain animation it is necessary to develop separate pictures of each of the different appearances or phases of the animation. Once these pictures have been obtained they are projected onto a common photosensitive transparent sheet one at a time and in the proper sequence to obtain animation. For example, using dark room technique, the picture containing the first appearance would be projected onto the transparent sheet 15 (FIG. 1) through an opaque grid 16 (FIG. 2) which has a series of openings 17 in a desired pattern. The opaque grid would be carefully placed over the transparent sheet 15 so that the openings 17 would permit small limited or finite portions of the projected appearance picture to be scattered over the transparent sheet. In this manner portions only of the first appearance picture would be developed in the small scattered areas 18 (numbered 1) over the entire surface of the transparent sheet 15. It should be understood that the areas 18 which are so developed are made up from different portions of the first appearance picture. These areas are very small, being of a size no larger than approximately 1/16 of an inch on a side, and the openings 17 in the grid 16 would be of a similar size. The size of the scattered areas 18 is important so that the very least amount of area is blocked by the opaque grid so as not to interrupt the overall impression of the picture.

The second appearance picture is then projected onto the sheet 15 but it is first necessary to shift the grid 16 so that the openings 17 expose scattered small areas of the second picture on adjacent area 19 of the sheet 15 while blocking off the areas 18 which have just been developed. Again, the second appearance picture is projected onto the sheet 15 and developed thereon so that all of the areas 19 of the second appearance picture expose through the grid openings 17 can be developed on the sheet 15. It requires careful alignment of the grid 16 over the sheet 15 to obtain the exposure of the first and second appearance picture areas next to each other so as to avoid a jumpy transition from the first to the second appearance areas. Thus, the second areas 19 from the appearance picture are developed on the sheet 15 in the areas 19.

The third appearance picture is then projected onto the sheet 15 and the grid 16 carefully shifted so that the openings 17 permit the third appearance picture portions to be exposed on and scattered about the sheet 15 in the areas 20. Again careful alignment of the grid 16 over the sheet 15 is necessary so as to avoid creating a jumpy transition between the appearance portions of area 19 and area 20. The fourth appearance picture is then projected on the sheet 15 after carefully shifting the grid 16 so that the fourth appearance picture areas are exposed adjacent the first and the third appearance picture areas. The fourth appearance picture areas would then appear on the sheet 15 at the areas 21.

It is noted that in the successive projection and development of the appearance pictures on the sheet 15 there is necessary careful relative movement between the sheet 15 and the grid 16 in horizontal and vertical directions, or along X and Y axes. It is preferred in developing the sheet 15 to retain it in a stationary position under the projector and to shift the grid 16 along the X and Y axes. Therefore, the sheet 15 would have in finite areas 18 different scattered portions of the first appearance picture, in finite areas 19 different scattered portions of the second appearance picture, in finite areas 20 different scattered portions of the third appearance picture, and in finite areas 21 different scattered portions of the fourth appearance picture. In each instance, the scattered finite areas need to be small so that when each set of areas is seen collectively the observer will still see enough of each appearance picture to obtain the desired animation result.

The sheet 15 when prepared in the above manner can be incorporated in a visual display apparatus (FIGS. 7 and 8) in which back lighting is provided and a suitable mask 22 is positioned in front of or at the viewing side of the transparent sheet. The mask would be a duplicate of the grid 16, except the apertures would be slightly smaller than the areas 17 in grid 16 so as to avoid exposure of fringes of the adjacent finite areas and thereby prevent a "halo" effect. The apparatus is arranged to progressively move the mask 22 successively over the appearance areas 18, 19, 20 and 21 at a speed that would bring out the shift in the visual display of such areas without noticably affecting the fact that the appearance areas are being changed in a sequence that results in developing animation. It has been found that normal facial expressions can be animated or the action of a walking person or animal can be simulated by shifting the transparent sheet 15 and mask 22 through all four sequences at about 75 to 80 cycles per minute.

In the accompanying drawings there has been disclosed means for effecting relative movement between the transparent sheet 15 and the opaque grid 16 previously described above. When the transparent sheet 15 has been fully developed with the several different appearances making up the visual display it is ready to be inserted into display apparatus 23 shown in FIGS. 7 and 8. In this apparatus the transparent sheet 15 is intended to be fixed in position in any suitable manner. A source of illumination may be a fluorescent lamp 24 located behind a glass or other transparent support 25 for the sheet 15. The source of illumination is such that a reflector 24A directs the light from the lamp upon a light diffusing member 25A positioned at the support 25 to avoid any areas that are lacking in sufficient illumination to be visible at a comfortable distance in front of the sheet 15. The mask 22 is placed in front of the sheet 15 and it is arranged with a series of openings 26 (FIGS. 3 to 6) arranged in an order which is a duplication of the opaque grid 16 and its openings 17, which grid was utilized in the production of the transparent sheet 15. However, as noted above, the apertures 26 are slightly smaller than the grid apertures 17. A front viewing glass panel 28 is located in front of the mask 22 so that the parts are protected and dirt can be excluded.

Turning now to FIGS. 8 to 11 inclusive, the display apparatus shown generally at 23 houses a shaft support 30 secured in the apparatus 23. Support 30 carries a bracket 31 formed with projecting ends 32 for the purpose of providing a bearing support for axially aligned stub shafts 33. The shafts 33 are intended to slide in the supports 32 and the outward movement is checked by adjustment screws 34 mounted in suitable brackets 35 secured to the supports 32 at means 36. The respective shafts 33 support a rockable frame 37 which is formed with a front panel 38 having rearwardly projecting elements 39 which are formed with axially aligned apertures 40 to receive the shafts 33. Set screws 41 are utilized to secure the shafts 33 in the elements 39 of the frame 37 because it is necessary to be able to shift the frame 37 in the direction of the axis of the shafts 33, as well as to rock the frame 37 about the axis of the shafts 33. The extend of shift of the frame 37 is determined by the location of the adjustment screws 34.

As shown in FIG. 8 the frame 37 is provided with a front support 42 for the purpose of forming an attachment for the upper margin 22A of the mask 22. The attachment 42 has a rounded surface so as not to distort the position of the mask 22 from its intended plainer position in front of transparency sheet 15. The rear surface of the panel 38 of frame 37 forms a base for the mounting of a plate 44 which carries four cam followers seen at 45, 46, 47 and 48. The respective followers project toward the bracket 31 so as to be in position to embrace a rotary cam 50 mounted on a shaft 51 which is driven by motor 52. The motor 52 is suitably mounted on the back surface of the support 30 and is enclosed within the display apparatus 23 so as to avoid exposure to dirt.

Figure 9:
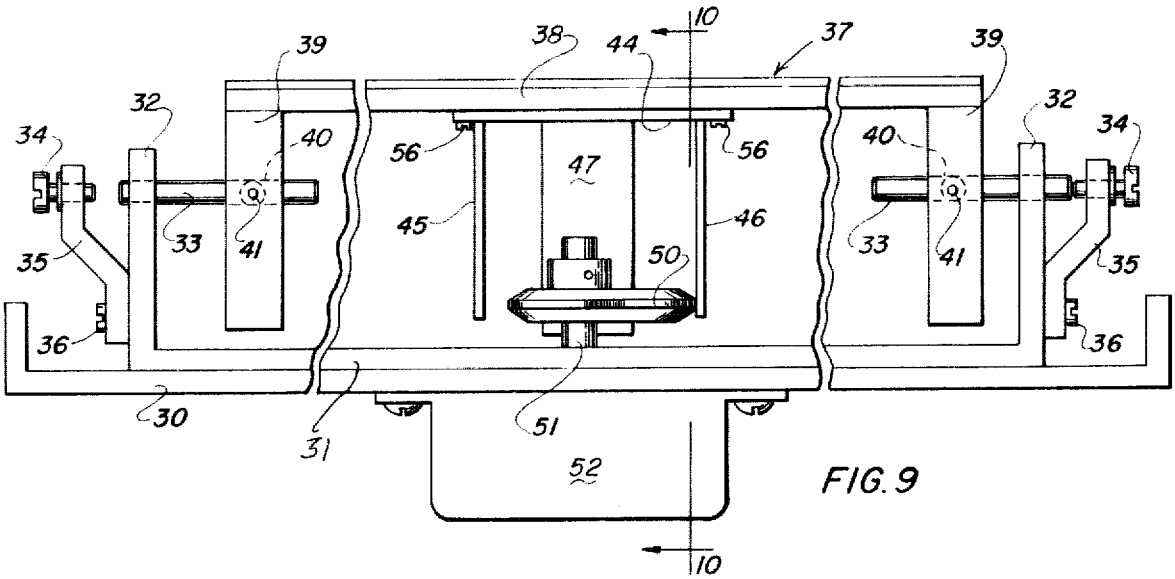
FIG. 9 is a view taken along line 9—9 in FIG. 8 to show the details of the operating mechanism.
Figure 10:
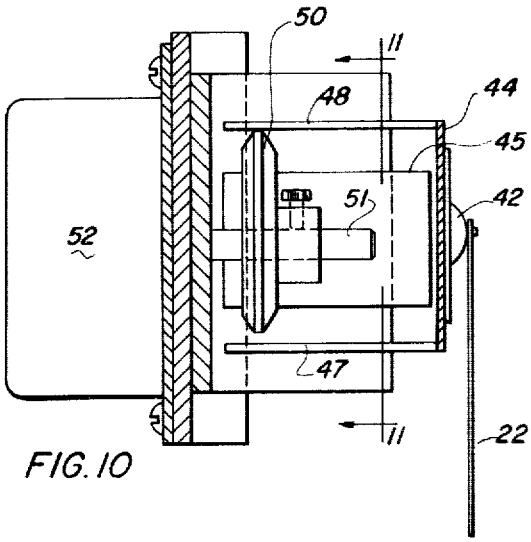
FIG. 10 is a sectional view taken along line 10—10 in FIG. 9.

As seen in FIGS. 9 and 10 the location of the cam 50 is behind the rocking axis for the frame 37 as defined by the axis of the shafts 33. This is important because the frame 37 needs to be rocked in a direction to shift the mask 22 in the vertical or Y axis direction. Concurrently with rocking of the frame 37, the rotation of the cam 50 is intended to shift the frame 37 horizontally or in the X axis direction which would be parallel with the axis of the shafts 33. The motion parallel with the shafts 33 is limited by the adjustment screws 34, and the rocking motion of the frame 37 is limited by similar adjustment screws 53 carried in suitable brackets 54 on the member 30 as shown in FIG. 8. The adjustment screws 53 may be located so as to be in a position to engage one or the other of the elements 39 (FIG. 9) of the rocking frame 37.

Figure 11:
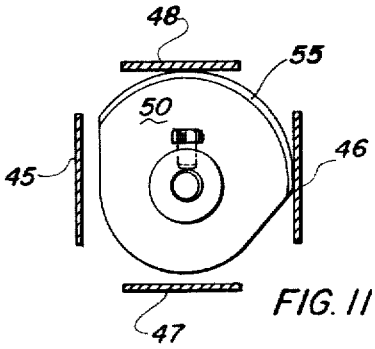
FIG. 11 is a further sectional view taken along line 11—11 in FIG. 10.

It can be seen in FIGS. 9 and 11 that the rotary cam 50 is formed with an operating profile 55 that is intended to be always engaged with any two of the cam followers 45 to 48, and as seen in FIG. 11 the profile 55 is in engagement with the cam followers 46 and 48, whereby the frame 37 will be free to rock and shift in the respective Y and X axes. As the cam rides on each follower after completing the change of direction from the X axis to the Y axis, and back to the X axis, there is a pause during which each display is stationary until the transition between the axes is reached. The transition itself is so fast that it is not detected. This operation develops the animation effect above referred to. In view of the size of the finite areas 18, 19, 20 and 21 on the transparency sheet 15, and the slightly smaller size of the apertures 26 in the mask 22 the amount of rocking motion and lateral shifting motion will not be very great. It is necessary to accurately locate the cam followers with respect to the cam profile 55 so that the sequence of shifting of the mask 22, as well as its rocking motion will be in the proper order in which the finite areas on the transparency sheet 15 have been placed. In order to obtain the necessary adjustments, the followers are carried on the base plate 44 which may be moved relative to the panel 38 and secured in position by means 56.

For small size display apparatus 23 such as may be found in commercial establishments, the motor 52 may be any of the available clock type synchronous motors having a geared drive (not shown) to the shaft 51 that will produce the desired 75 to 80 cycles per minute as above indicated.

Figure 2:
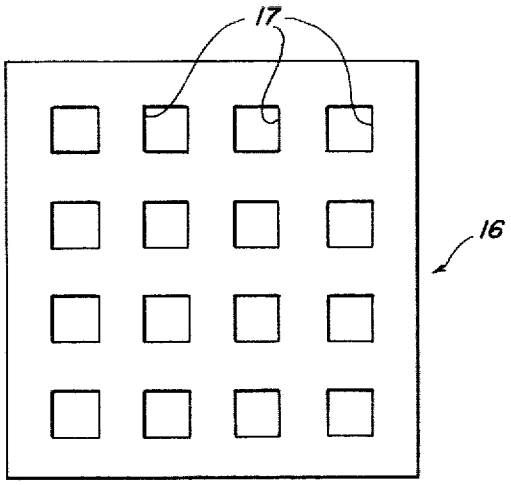
FIG. 2 is a plan view of a grid sheet used in the development of the several finite areas designated in FIG. 1.
Figure 3:
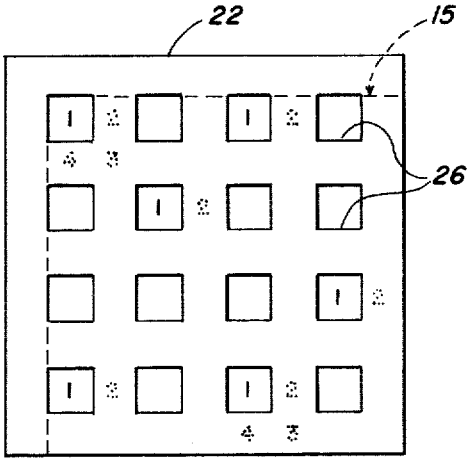
FIG. 3 is a plan view of the transparency sheet aligned behind a mask in which apertures are provided so that all common finite areas are viewable at one time and other areas are masked from view.
Figure 4:
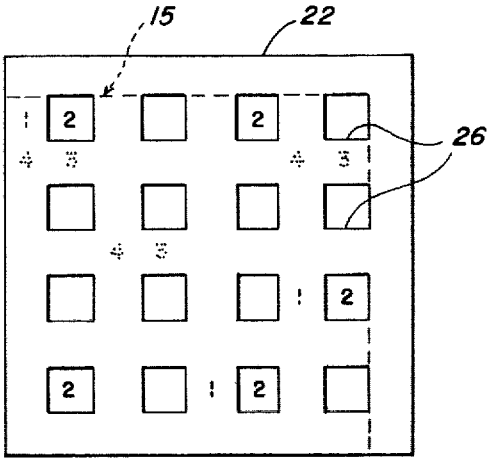
FIGS. 4, 5 and 6 are views similar to FIG. 3, but illusrating the progression of relative movment of transparency and mask to bring to view other finite areas in a predetermined order.
Figure 6:
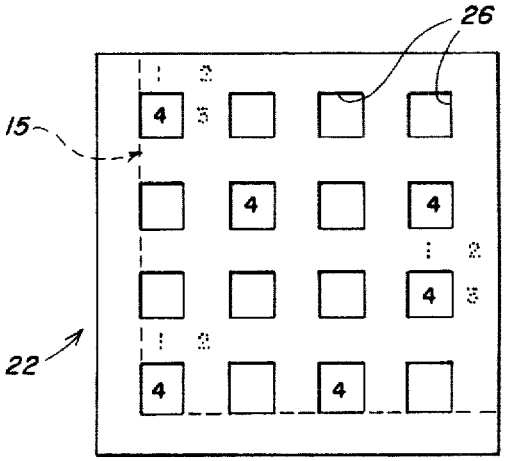
Figure 5:
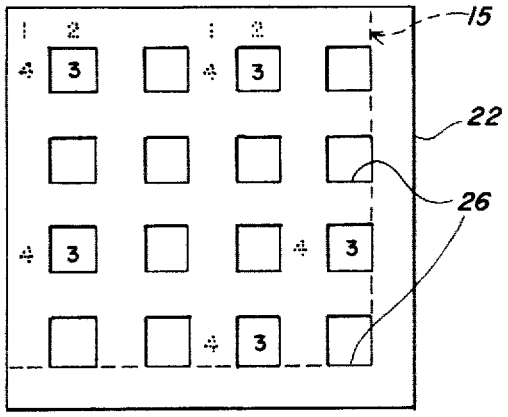
Figure 12:
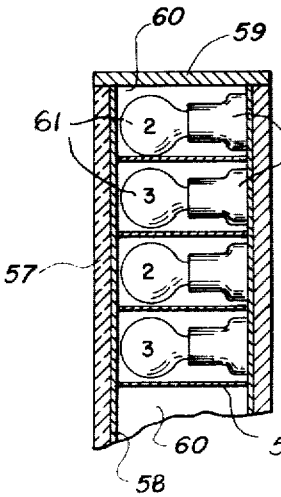
FIG. 12 is a fragmentary view of a modification showing a source of illumination associated with the individual finite areas of a transparent display sheet.
Figure 13:
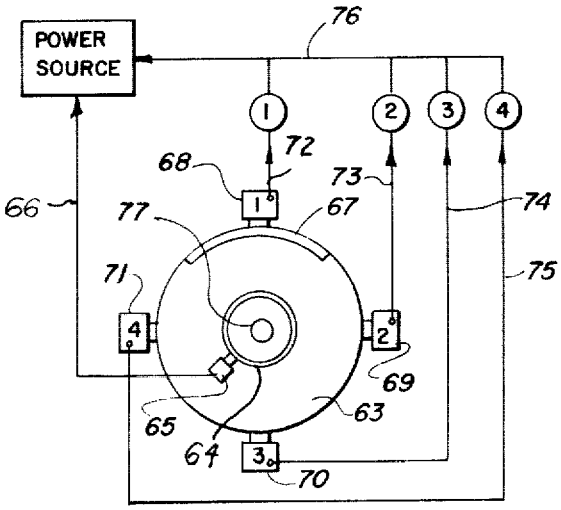
FIG. 13 is a schematic view of apparatus electrically associated with the illumination sources seen in FIG. 12 for effecting the sequential power supply to the illumination.

Turning now to FIGS. 12 and 13, there is shown an electrical circuit arrangement for obtaining sequential illumination of the individual finite areas which have been photographically reproduced on a transparent plate 56 of the type shown in FIG. 1. It is seen in FIG. 12, in a fragmentary way, the support of the transparent sheet 58 on a suitable transparent plate 57 which may be glass or plexiglass. An enclosing box B is adapted to receive the transparent sheet 58 so it is exposed to view. The interior of the box is formed with longitudinal and transverse walls 59 and 60 (in egg crate fashion) which form a series of pockets where each pocket is aligned with a finite area on the sheet 58. Each pocket of the box B carries a lamp 61 mounted in a suitable socket 62 so that each finite area of the sheet 58 is provided with its own source of illumination. The lamps 61 are sequentially illuminated as shown in the schematic diagram of FIG. 13. In this view a rotor 63 is provided with a slip ring 64 which is engaged by a contact brush 65 connected by lead 66 in one side of a power circuit. The rotor 63 carries a commutator segment 67 which extends over the circumference of the rotor so that individual spaced brushes 68, 69, 70 and 71 are in contact with the commutator segment without any simultaneous engagement with any two of the brushes making contact at the same time. The contact brush 68 is connected by a suitable system of leads, one being shown at 72, with all of the lamps 61-1 aligned with the finite segments numbered one on the transparent sheet 58. Contact brush 69 is similarly connected by a system of leads, one being shown at 73, to each one of the lamps 61-2 aligned with the similarly numbered finite areas on the transparent sheet 58. In a similar manner contact brush 70 is connected by a system of leads, one being shown at 74, to all of the lamps 61-3 aligned with the similarly numbered finite areas on the sheet 58. Finally contact brush 71 is connected by lead 75 to all of the lamps 61-4 associated with the similarly numbered finite areas on sheet 58. All of the lamps 61 have a common lead 76 forming the other side of the power source as shown in FIG. 13. A suitable motor (not shown) connected to shaft 77 drives the rotor 63 at such a speed that the respective finite areas on the sheet 58 are sequentially illuminated in the proper order to develop the display on the sheet 58 so as to bring out the subject matter in the desired manner. It has been found that by driving the rotor 63 to produce cyclic contact at the brushes 68 through 71 in the order of 75 to 80 cycles per minute will develop the desired result.

The arrangement described in connection with FIGS. 12 and 13 produces the same result as that described in connection with the assembly shown in FIGS. 8 and 9, but by providing individual illumination of the several finite areas it is not necessary to provide a movable mask such as the mask 22 shown in the sequence of views of FIGS. 3 through 6 inclusive. It is necessary to design the walls 59 and 60 so there will be no significant light leakage at the face of the sheet 58, otherwise a halo effect might be produced. In this arrangement the visual display may be adapted for bill board size installations, and the only moving part would be the motor driven rotor 63 which could be housed in a weather-proof enclosure.

The foregoing description has set forth a presently preferred embodiment of display apparatus which will develop the presentation of a sequence of subject matter in differing visual appearances by first developing a common transparency sheet with interspersed areas of each of the sequence of subject matter, and providing operative means in the form of a mask, or of a system of individual lights to effectively present each subject matter in sequence, one at a time, so that the overall visual appearance of the display would change in a well defined order. In either embodiment, methods of manufacture and operation can be utilized to present a display of at least four independent appearances, or it may be applied to a common subject matter that can be presented in a sequence of motion to bring out a desired animation thereof. When providing a large, bill board size, display the finite areas need to be enlarged for practical reasons. The enlarged areas may be formed so as to be about twenty-four times larger on a side, making the ratio of dimension as between a small display and a bill board display of the order of one to twenty-four (1/16 inch to 1 and ½ inch).

Having presented preferred embodiments of the present invention, and the details of the apparatus associated therewith, it should be understood that variations and alterations may be made without departing from the scope of the present disclosure.

What is claimed is:

1. A method of displaying in sequence subject matter in differing visual appearances, the method comprising: providing separate pictures of the differing visual appearances of subject matter to be displayed; reproducing each separate picture one at a time on a light transparent sheet with each such picture reproduced thereon in a plurality of finite portions spaced apart from each other such that the finite portions of each picture are arranged in a plurality of rectangular patterns in which each picture has its finite portions located in the same position in each of the rectangular patterns, and the rectangular patterns are repeated over the area of the light transparent sheet in a rectangular order having horizontal and vertical relationships, the finite portions of each picture being spaced in horizontal and vertical alignment so that the collective finite portions of each picture are displayed at the same time; providing a source of illumination for the transparent sheet; sequentially limiting the illumination to display all of the finite portions of one picture at a time, and proceeding through the illumination of each subsequent picture; and repeating the illumination of each picture always proceeding in the same horizontal and vertical direction of alignment of the respective finite portions.

2. In apparatus presenting a visual display of subject matter in differing appearances, the improvement which comprises: a light transparent sheet carrying finite areas of a plurality of differing appearances in which the finite areas of each appearance are interspersed with the other finite areas in a predetermined rectangular order of interspersal; a source of illumination adjacent said transparent sheet for illuminating said differing appearances; and operative means in control of said source of illumination for limiting the illumination of said finite areas to the separate collective display of one differing appearance at one time and in said predetermined rectangular order such that each collective differing appearance from a first to the last is illuminated and is repeated always in the same order, said operative means including a frame, means carried by said frame in position such that the finite areas of each differing appearance are collectively prepared for display; and rotary means for controlling the source of illumination to conform to said predetermined rectangular order for display of said collective finite areas of each differing appearance.

3. The improvement of claim 2 wherein said rotary means for controlling the source of illumination is a cam and said frame carries cam follower means, said rotation of said cam relative to said follower means moves said frame horizontally and vertically in selective sequence for effecting the illumination of said differing appearances in said predetermined rectangular order, and said cam follower means are positioned adjacent the path of travel of said cam and in operative positions to be moved by the cam rotation such that said frame is correspondingly moved horizontally and vertically in said selective sequence.

* * * * *